US007694703B2

(12) United States Patent
Grady

(10) Patent No.: US 7,694,703 B2
(45) Date of Patent: Apr. 13, 2010

(54) APPARATUS FOR DISPENSING PARTICULATE MATERIAL AND COMPONENTS THEREFOR

(75) Inventor: Ayton J. Grady, Muskoka (CA)

(73) Assignee: Gradmatic Equipment Inc., Ontario (CA)

( * ) Notice: Subject to any disclaimer, the term of this patent is extended or adjusted under 35 U.S.C. 154(b) by 1198 days.

(21) Appl. No.: 10/519,917

(22) PCT Filed: Jul. 3, 2002

(86) PCT No.: PCT/CA02/01002

§ 371 (c)(1),
(2), (4) Date: Aug. 1, 2005

(87) PCT Pub. No.: WO2004/005821

PCT Pub. Date: Jan. 15, 2004

(65) Prior Publication Data

US 2006/0163283 A1 Jul. 27, 2006

(51) Int. Cl.
*B67C 3/26* (2006.01)
*B67D 5/64* (2006.01)

(52) U.S. Cl. ..... 141/256; 141/67; 141/73; 222/168; 222/413; 414/526

(58) Field of Classification Search ..... 141/65, 141/67, 70, 73, 94, 95, 256; 222/167–172, 222/412–414; 414/401, 526
See application file for complete search history.

(56) References Cited

U.S. PATENT DOCUMENTS 5,016,686 A * 5/1991 Gerstenkorn ..... 141/96
5,058,776 A 10/1991 Grady et al.
5,101,961 A 4/1992 Baldwin et al.
5,655,690 A * 8/1997 DeGoler et al. ..... 222/380
5,697,408 A * 12/1997 Reeves ..... 141/284
5,988,951 A * 11/1999 DiFrank et al. ..... 406/32
6,102,088 A * 8/2000 Wegman ..... 141/286
6,170,718 B1 * 1/2001 Ziegler et al. ..... 222/450
6,199,684 B1 * 3/2001 Huth ..... 198/524

FOREIGN PATENT DOCUMENTS

JP 63-154258 A 6/1988

OTHER PUBLICATIONS

Patent Abstracts of Japan, vol. 12, No. 416 (M-759), Nov. 4, 1988.

* cited by examiner

*Primary Examiner*—Timothy L Maust
(74) *Attorney, Agent, or Firm*—Harness, Dickey & Pierce, P.L.C.

(57) ABSTRACT

A particular dispensing apparatus (10) for dispensing with particular refractory material into a gap between a furnace wall and a form includes a platform (12) removably engaging the upper end of an expendable metal form. A carriage (14) is pivotally coupled to the platform and is rotatable about a pivot point located generally at the center of the platform. A hopper (30) is coupled to the carriage. The hopper receives particulate refractory material via an inlet and dispenses the particulate refractory material through an outlet (36). A feeder (34) is coupled to the outlet of the hopper to move the particulate refractory material from the outlet to a dispenser (44). The dispenser is coupled to the carriage at a distal end of the feeder and is suspended above the lining gap to deliver particulate refractory material into the lining gap. An air extractor device (170) is coupled to the carriage for removing air from particulate refractory material in the lining gap and for re-compacting the particulate refractory material.

33 Claims, 12 Drawing Sheets

APPARATUS FOR DISPENSING PARTICULATE MATERIAL AND COMPONENTS THEREFOR

TECHNICAL FIELD

The present invention relates to an apparatus for use in producing a refractory lining within a foundry furnace, in particular, to an apparatus for dispensing particulate refractory material into an annular space defined between an inner furnace surface and an expendable metal form within the furnace, in preparation for sintering into a continuous lining.

BACKGROUND ART

A common foundry induction furnace typically comprises a cylindrical furnace wall including an induction heating coil, and a continuous lining formed of sintered silica or other refractory material defining a chamber for containing molten metal, such as iron melt. From time to time, the lining becomes eroded and requires replacement. Following removal of the worn lining an expendable steel cylindrical form is concentrically installed within the furnace. The outer surface of the form is spaced apart from the inner surface of the furnace so as to define an annular space therebetween. Refractory particulate material is then manually poured into the annular space. Once the annular space has been filled, the refractory material is sintered first by gas heaters fired into the furnace, and thereafter by an initial charge of molten iron melted within the furnace. The initial charge also melts the expendable form to reveal the sintered lining.

Manual pouring of the refractory material into the annular space is strenuous, labor intensive work. Workers are required to wear protective clothing and use respirators to guard against airborne particulate dust that may pose health risks. Foundries are under increased pressure to operate within environmental guidelines, and therefore, manual pouring of refractory material has become increasingly undesirable. In addition, during manual pouring of the refractory material air tends to be entrapped in the particulate material resulting in voids in the lining that physically weaken the lining or create pockets of over heated metal. Human variability, such as inexperience and fatigue, results in inconsistencies in the lining, which lead to unpredictable refractory life and production schedules from one lining to the next.

To deal with the problems associated with manual pouring of refractory material, an automated particle dispensing apparatus has been considered and is disclosed in U.S. Pat. No. 5,058,776. Although this apparatus produces more consistent linings than the manual method, it has been found that when pouring refractory material having fine grain sizes of particulate material the apparatus does not always deliver a smooth flow of refractory material into the annular space. This can result in an uneven distribution of particulate material, which may produce a substandard lining.

It is therefore an object of the present invention to provide a particulate dispensing apparatus that obviates or mitigates the above disadvantages.

DISCLOSURE OF THE INVENTION

According to one aspect of the present invention there is provided a particulate dispensing apparatus for dispensing particulate refractory material into a lining gap defined between an inner furnace surface and an expendable metal form, the particulate dispensing apparatus comprising:

a platform supporting a carriage adjacent an upper end of the expendable metal form, the carriage being pivotally coupled to the platform and rotatable about a pivot point located generally at the center of the platform;

a hopper coupled to the carriage, the hopper for receiving particulate refractory material via an inlet and dispensing the particulate refractory material through an outlet;

a feeder coupled to the outlet of the hopper, the feeder for moving the particulate refractory material from the outlet to a dispenser, the dispenser being coupled to the carriage at a distal end of the feeder and being suspended above the lining gap to deliver particulate refractory material into the lining gap;

an air extractor device coupled to the carriage for removing air from particulate refractory material deposited in the lining gap and for re-compacting the particulate refractory material; and driving means for rotating the carriage relative to the platform.

In the preferred embodiment, the feeder includes a trough coupled to the hopper outlet and an auger extending through the trough. The auger is rotatable to deliver particulate refractory material received from the hopper to the dispenser. Preferably, the auger includes a continuous blade having a pitch that increases in a direction toward the dispenser.

Preferably, the air extractor device includes a pair of reciprocating forks and the dispenser includes a telescoping shaft. A sensor is coupled to the dispenser fort detecting the level of particulate refractory material in the lining gap. A controller is responsive to the sensor to adjust the length of the telescoping shaft.

An accumulator may be dispensed between the feeder and dispenser to stall the flow of particulate refractory material so that the dispenser receives particulate refractory material at a constant rate. The hopper and feeder are configured to provide for smooth and consistent flow of particulate refractory material from the hopper to the accumulator.

According to another aspect of the present invention there is provided a particulate dispensing apparatus for dispensing particulate refractory material into a lining gap between an inner furnace wall and an expendable metal form, the particulate dispensing apparatus comprising:

a platform supporting a carriage adjacent an upper end of the expendable metal form, the carriage being pivotally coupled to the platform and rotatable about a pivot point located generally at the centre of the platform;

driving means for rotating the carriage relative to the platform;

a hopper coupled to the carriage, the hopper for receiving particulate refractory material via an inlet and dispensing the particulate refractory material through an outlet; and a feeder coupled to the outlet of the hopper, the feeder having an auger extending through the length thereof having an encircling blade for moving the particulate refractory material from the outlet to a dispenser, the dispenser being coupled to the carriage at a distal end of the feeder and being suspended above the lining gap to deliver particulate refractory material into the lining gap;

wherein the auger blade has a variable pitch that increases in a direction toward the dispenser.

According to yet another aspect of the present invention there is provided a particulate dispensing apparatus for dispensing particulate refractory material into a gap between a furnace wall and a form comprising:

a frame assembly disposed above the form and including a carriage movable along a circular path above the gap;

a particulate refractory material feed assembly on the frame assembly for delivering particulate refractory material in a smooth and consistent manner to a dispenser on the carriage, the dispenser being suspended above the gap and delivering particulate refractory material into the gap in a manner to reduce the occurrence of airborne particulate material; and a drive for moving the carriage.

The present invention provides advantages in that the foundry furnace can be lined automatically while reducing the volume of airborne particulate material that arises during the lining process. As a result, improved health conditions are provided for workers. The present invention also provides advantages in that since the air extractor device removes air trapped in the particulate refractory material, the quality of the lining is improved. Furthermore, the present invention provides advantages in that the hopper and feeder design provide for smooth and consistent flow of particulate refractory material to the retractable shaft assembly. This allows the particulate dispensing apparatus to be used with virtually any particulate refractory material grain size while still depositing a consistent lining.

BRIEF DESCRIPTION OF THE DRAWINGS

An embodiment of the present invention will now be described more fully with reference to the accompanying drawings in which.

BEST MODE FOR CARRYING OUT THE INVENTION

Figure 1:
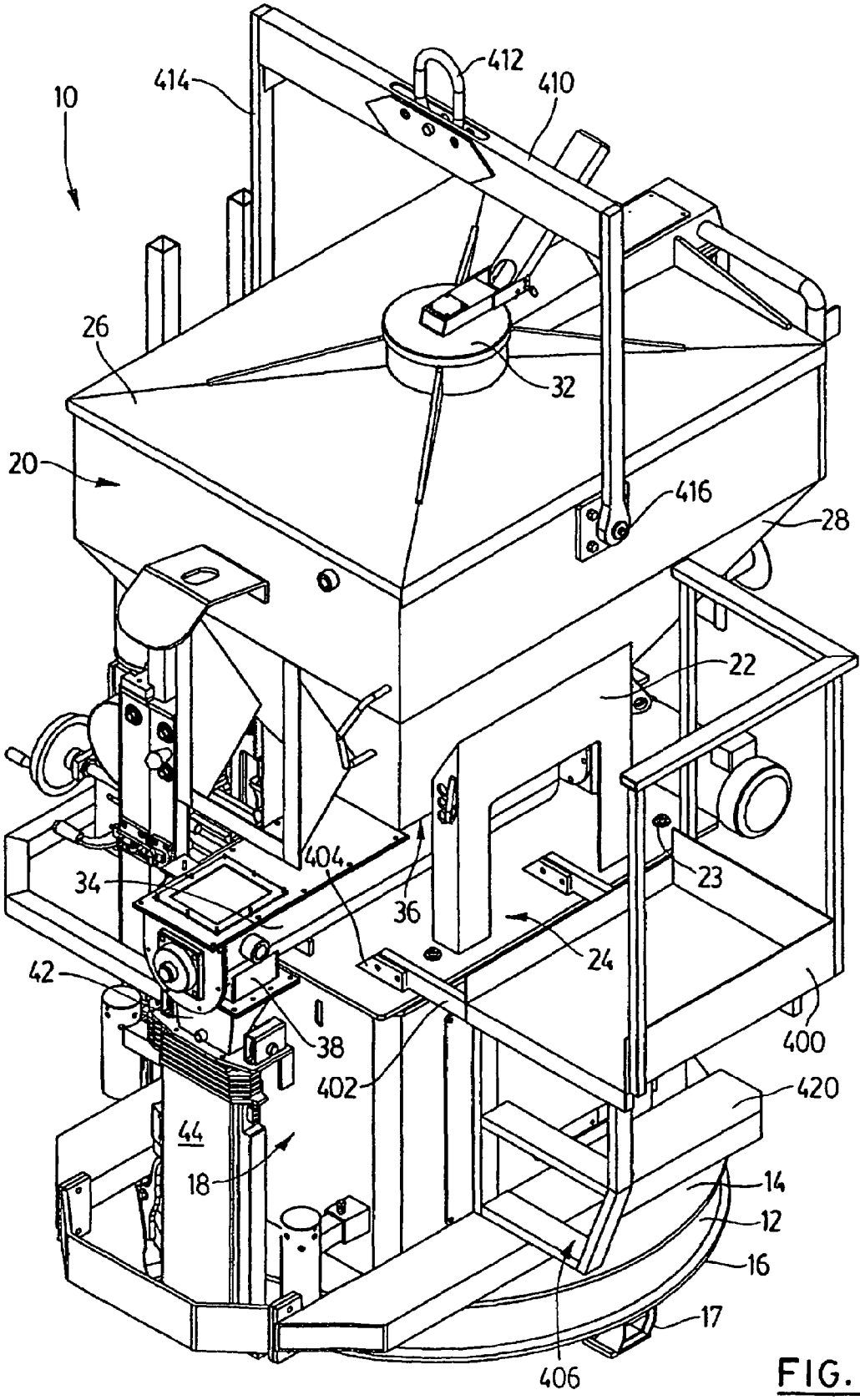
FIG. 1 is a front isometric view of a particulate dispensing apparatus in accordance with the present invention.
Figure 2:
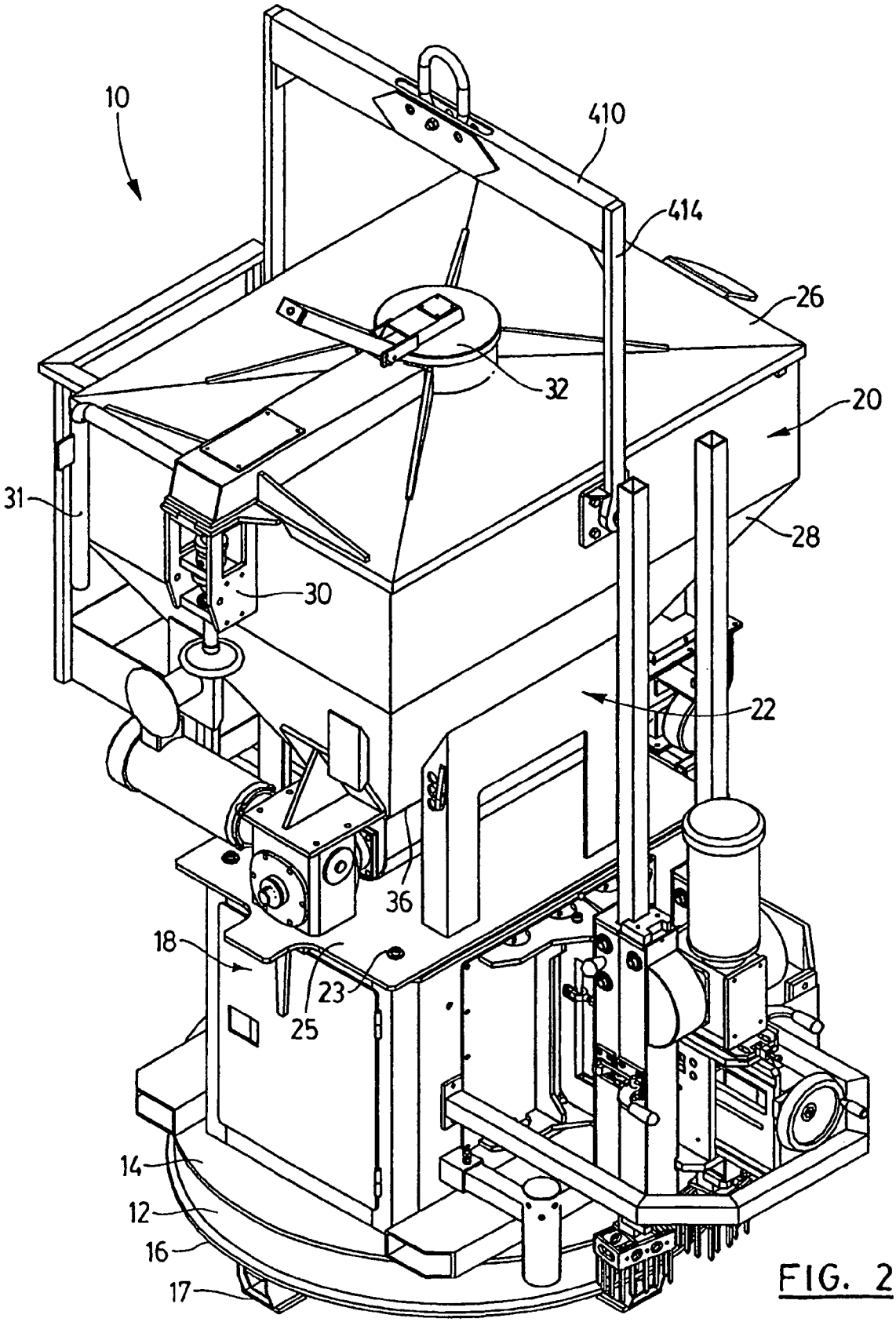
FIG. 2 is a rear isometric view of the particulate dispensing apparatus of FIG. 1.

Referring to FIGS. 1 and 2, a particulate dispensing apparatus for delivering particulate refractory material into the annular space between an expendable form and an inner furnace surface is generally shown at 10. The apparatus 10 includes a carriage 14 that is pivotally mounted to a circular platform 12 defining a rim 16. The rim 16 is sized to fit about the open top of an expendable cylindrical form (not shown) installed within a foundry furnace (not shown). A base assembly 17 is disposed beneath and supports the platform 12.

The carriage 14 is coupled to the platform 12 by a pivot assembly (not shown). The pivot assembly supports the carriage 14 and allows it to rotate about a central vertical axis extending generally at a right angle to the plane of the platform 12. A housing 18 is welded to the carriage 14. A drive (not shown) contained within the housing 18 is actuable to rotate the carriage 14 relative to the platform 12.

A hopper 20 receives particulate refractory material, such as silica for example, through an inlet and delivers the refractory material to an outlet 36. The hopper 20 is supported above the housing 18 by a pair of U-shaped side frames 22 that are welded to and extend outwardly from a top surface 24 of a hopper mounting plate 25. The hopper mounting plate 25 is secured to the top of the housing 18 by bolts 23. The hopper 20 includes a lid 26 that is pivotally coupled to a hopper body 28 to selectively cover the inlet of the hopper 20. A lid lifter assembly 30, which extends between the hopper body 28 and the lid 26, is actuable by an operator to raise and lower the lid 26. Electrical slip rings 32 are provided on the lid 26 and are coupled to a power supply. In this manner, the electrical slip rings 32 provide power to the particulate dispensing apparatus 10.

Figure 3:
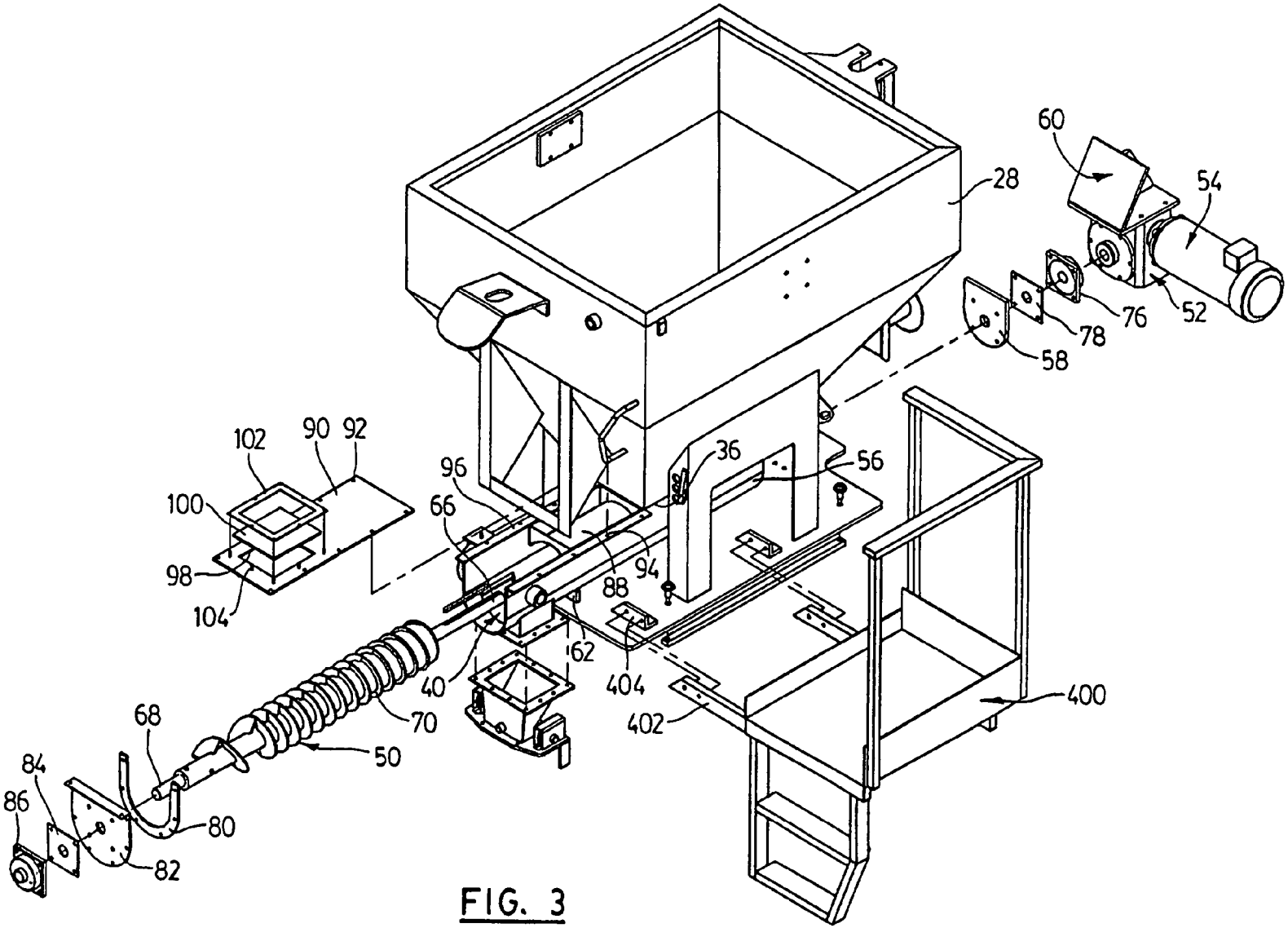
FIG. 3 is an exploded front isometric view of a hopper, a feeder and an operator platform of the particulate dispensing apparatus of FIG. 1.
Figure 4A:
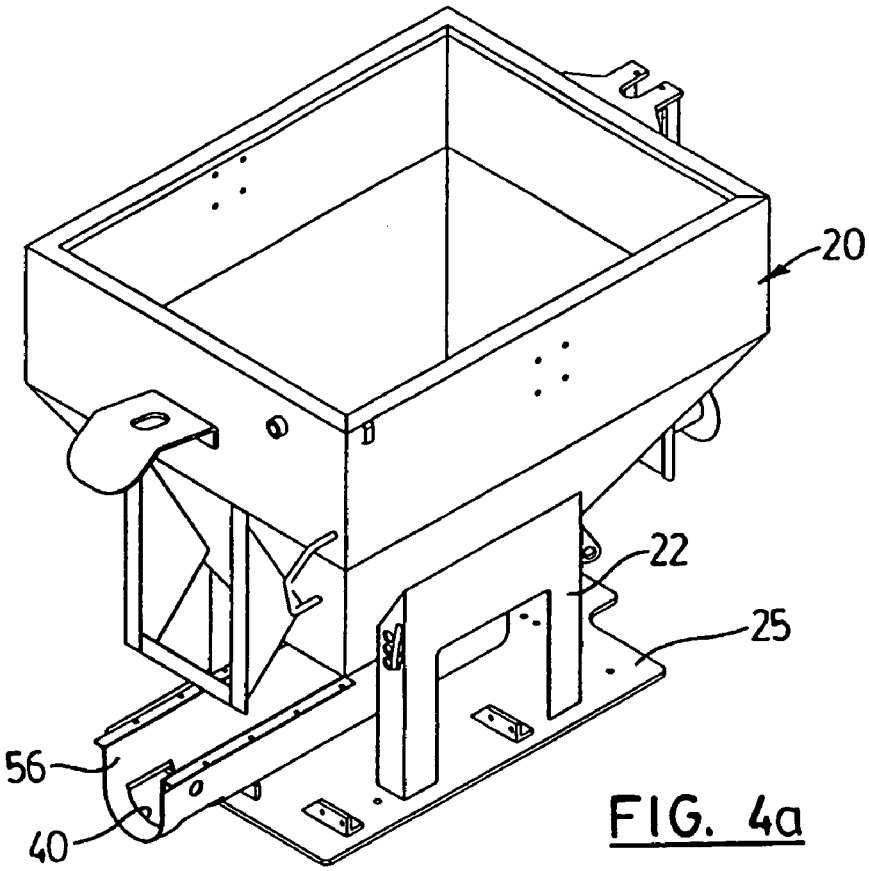
FIG. 4*a* is a front isometric view of portions of FIG. 1.
Figure 4B:
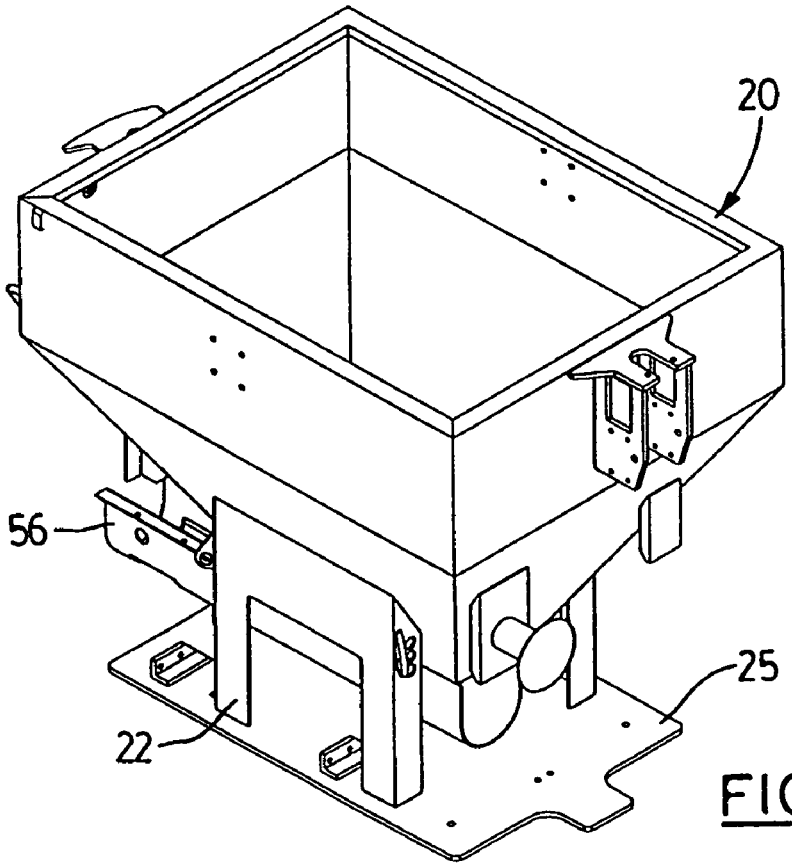
FIG. 4*b* is a rear isometric view of FIG. 4*a;*
Figure 4C:
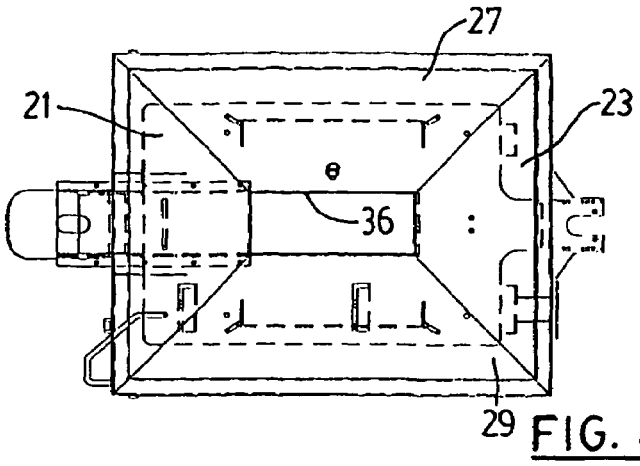
FIG. 4*c* is a top view of FIG. 4*a;*
Figure 4D:
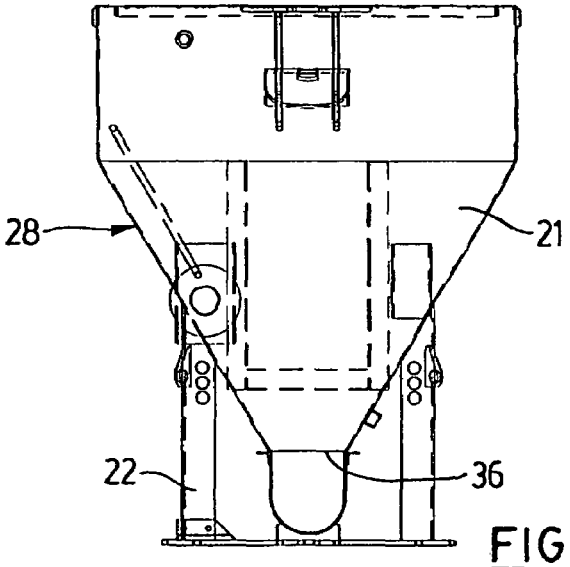
FIG. 4*d* is a rear view of FIG. 4*a;*
Figure 4E:
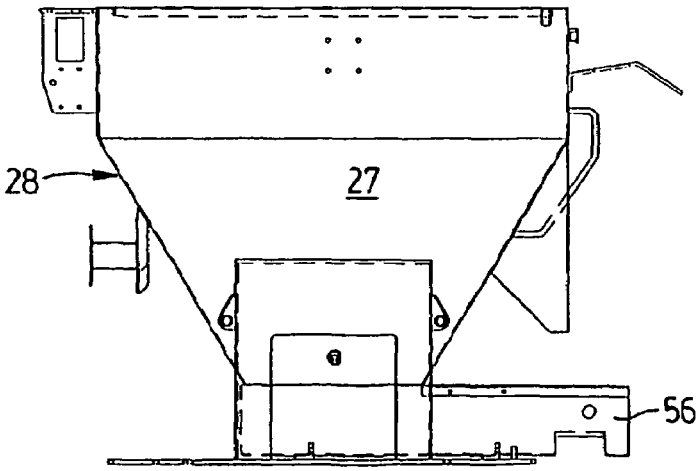
FIG. 4*e* is a side view of FIG. 4*a;*

A feeder 34 is coupled to the outlet 36 of the hopper 20. The feeder 34 receives the particulate refractory material and delivers it to a discharge chute 38 that is coupled to a feeder outlet 40 (shown in FIG. 3). The discharge chute 38 in turn is coupled to an accumulator box 42. A dispenser, or retractable shaft assembly 44 is coupled to the accumulator box 42 and receives particulate refractory material from the discharge chute 38.

The particulate dispensing apparatus 10 further includes an operator platform 400 coupled to one side thereof. An operator typically mounts the operator platform 400 via steps 406 in order to access the hopper 20. The operator may use the operator platform 400 to direct bulk bags of particulate refractory material into the hopper 20 when the hopper 20 is being filled, for example. The operator platform 400 includes outwardly extending struts 402 that are secured to brackets 404. The brackets 404 are mounted on an upper surface 24 of the hopper mounting plate 25.

A lifting assembly 410 having a hook 412 fastened thereto is provided to allow the entire particulate dispensing apparatus 10 to be lifted into a foundry furnace and removed from the foundry furnace following completion of the lining production process. The lifting assembly 410 includes a pair of arms 414 that are pivotally coupled to the hopper body 28 by fasteners 416. A pair of channels 420 is welded to the carriage 14 for receiving forks of a towing device (not shown). The pair of channels 420 provides an alternate means for transporting the particulate dispensing apparatus 10.

Turning to FIGS. 3 and 4*a* to 4*e*, the hopper 20 and feeder 34 are better illustrated. As can be seen, hopper body 28 includes front and rear walls 21 and 23, respectively and opposing sidewalls 27 and 29. The front and rear walls 21 and 23 preferably extend upwardly and outwardly from the hopper outlet 36 at an angle of approximately 30 degrees from a vertical axis. The opposing sidewalls 27 and 29 also preferably extend upwardly and outwardly from the hopper outlet 36 at an angle of approximately 30 degrees from a vertical axis. The walls of the hopper 20 are relatively steep to ensure that particulate refractory material flows smoothly toward the hopper outlet 36.

The feeder 34 comprises an auger 50, which is coupled through a gear reducer 52 to a motor 54. The gear reducer 52 is secured the rear wall 23 of the hopper body 28 by a mounting plate 60. A trough 56 surrounds the auger 50 and is coupled to the gear reducer 52 through a rear end plate 58 by fasteners (not shown). The trough 56 is in communication with the outlet 36 of the hopper 20 and receives particulate refractory material therefrom. The trough 56 is further supported by a spacer 62, which is located between the upper surface 24 of the hopper mounting plate 25 and the trough 56. The feeder outlet 40 is located forward of the front wall 21 and is generally aligned with the gap provided between the inner surface of the furnace and the expendable form.

Figure 5:
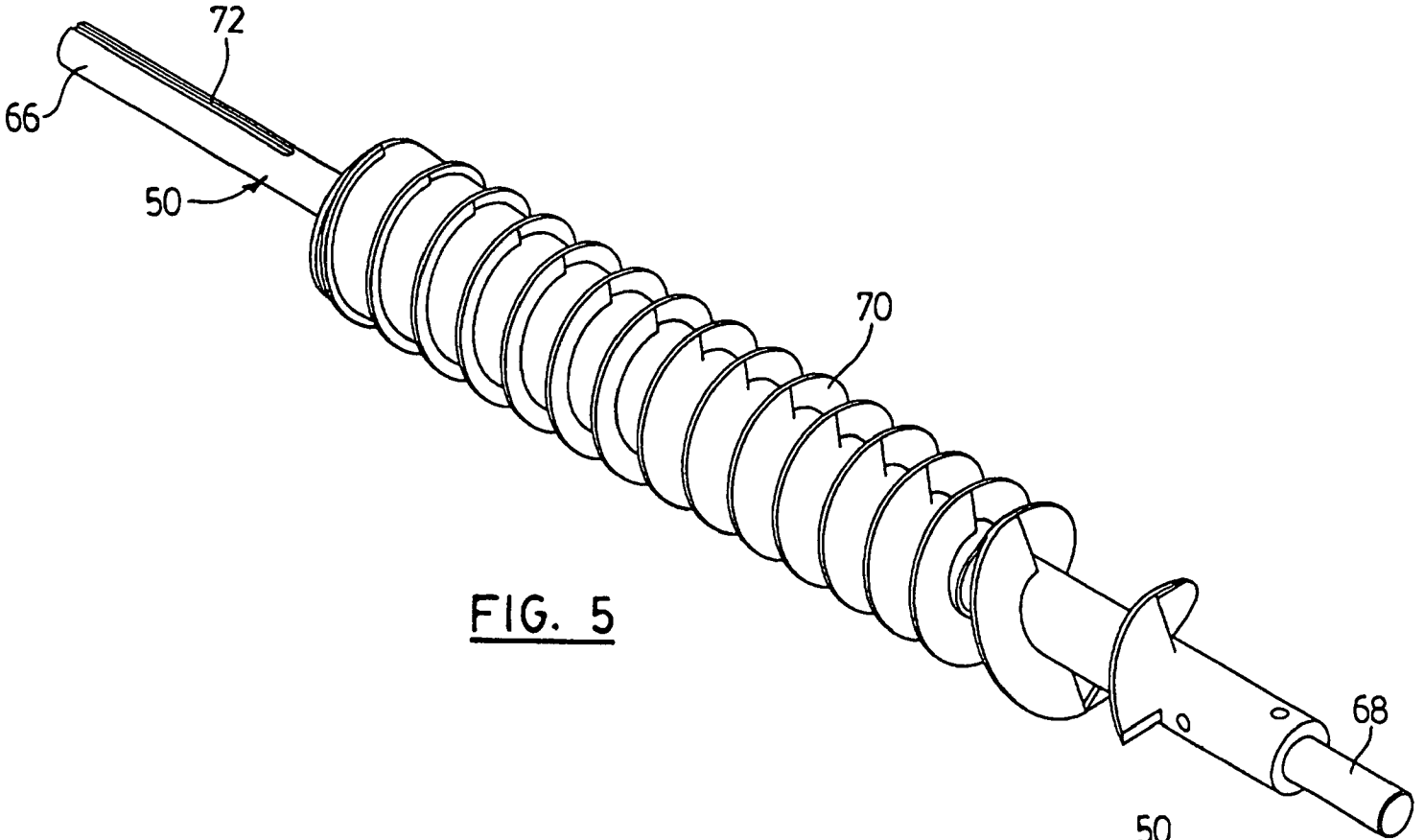
FIG. 5 is an isometric view of portions of FIG. 3.
Figure 6:
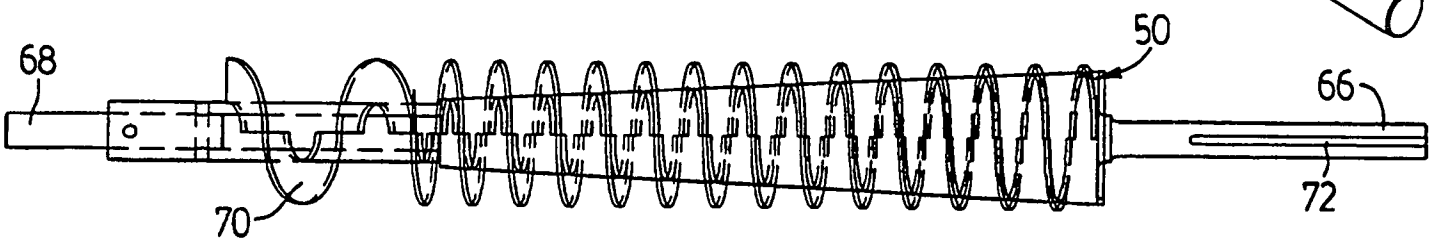
FIG. 6 is a side view of FIG. 5.

The auger 50 is rotatable about an auger axis 64 to move particulate refractory material from a driven end 66 to an outlet end 68 of the auger 50. The blade 70 of the auger 50 has a variable pitch, which increases in length toward the outlet end 68 of the auger, as shown in FIGS. 5 and 6. The driven end 66 of the auger 50 includes a slot 72 for receiving a key 74. The driven end 66 extends through the rear end plate 58 of the trough 56 and through a plate 78 to engage the gear reducer 52. A first bearing 76 is provided between the gear reducer 52 and the plate 78 to support the driven end 66 of the auger 50. The key 74 allows rotational motion to be transferred from the gear reducer 52 to the auger 50. The outlet end 68 of the auger 50 extends through a trough end flange 80, a forward end plate 82, a second plate 84 and is supported by a second bearing 86.

A shroud 88 is provided in the trough 56 to maintain the particulate refractory material in contact with the blade 70 of the auger 50. The shroud 88 is formed of steel and is bolted to trough 56. A clearance of approximately ⅜ inches is provided between the auger 50 and the trough 56 to inhibit jamming of the auger 50.

A trough cover 90 having an aperture 98 formed therein is provided to cover the forward end of the trough 56. The trough cover 90 is secured to the forward end of the trough 56 by fasteners (not shown). Holes 92 are provided in the trough cover 90 and mating holes 94 are provided in an upper flange 96 of the trough 56. The holes 92 and 94 are aligned to receive the fasteners. A lens 100 is secured to the trough cover 90 at the location of the aperture 98 by a lens keeper 102. Lens keeper 102 is coupled to the trough cover 90 by fasteners 104. The lens 100 allows an operator to see inside the feeder 34 at the outlet end 68 of the auger 50 and observe the flow of particulate refractory material. In a preferred embodiment, the aperture 98, lens 100 and lens keeper 102 form an illuminated inspection window.

Figure 7A:
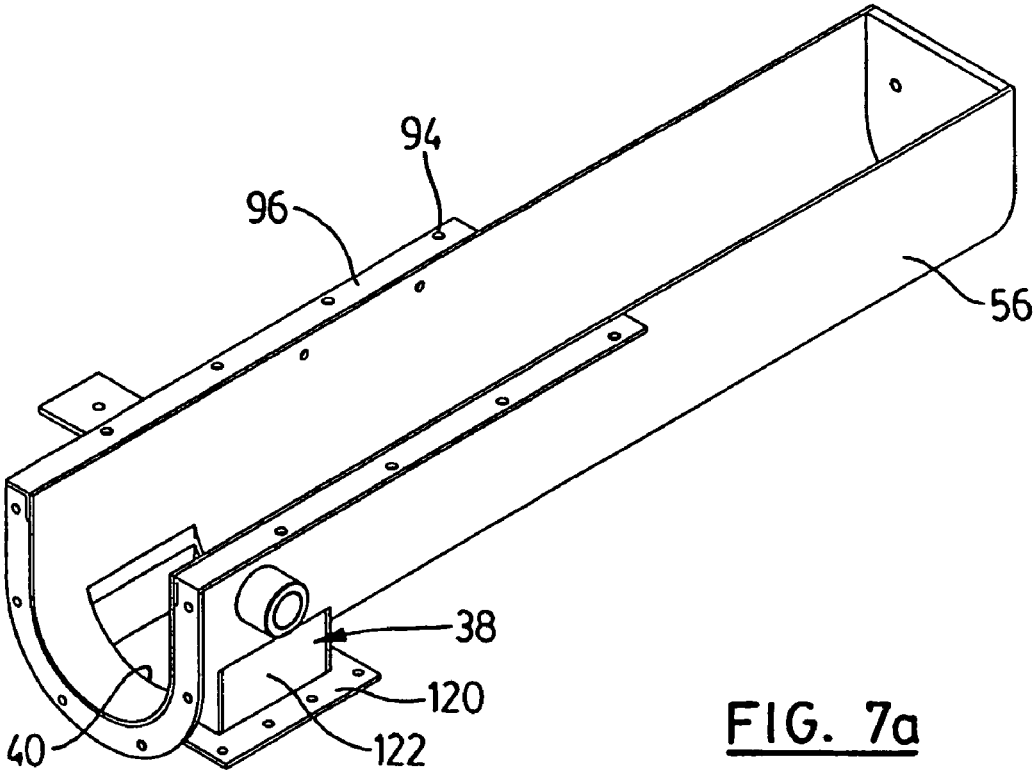
FIG. 7*a* is a front isometric view of portions of FIG. 1.
Figure 7B:
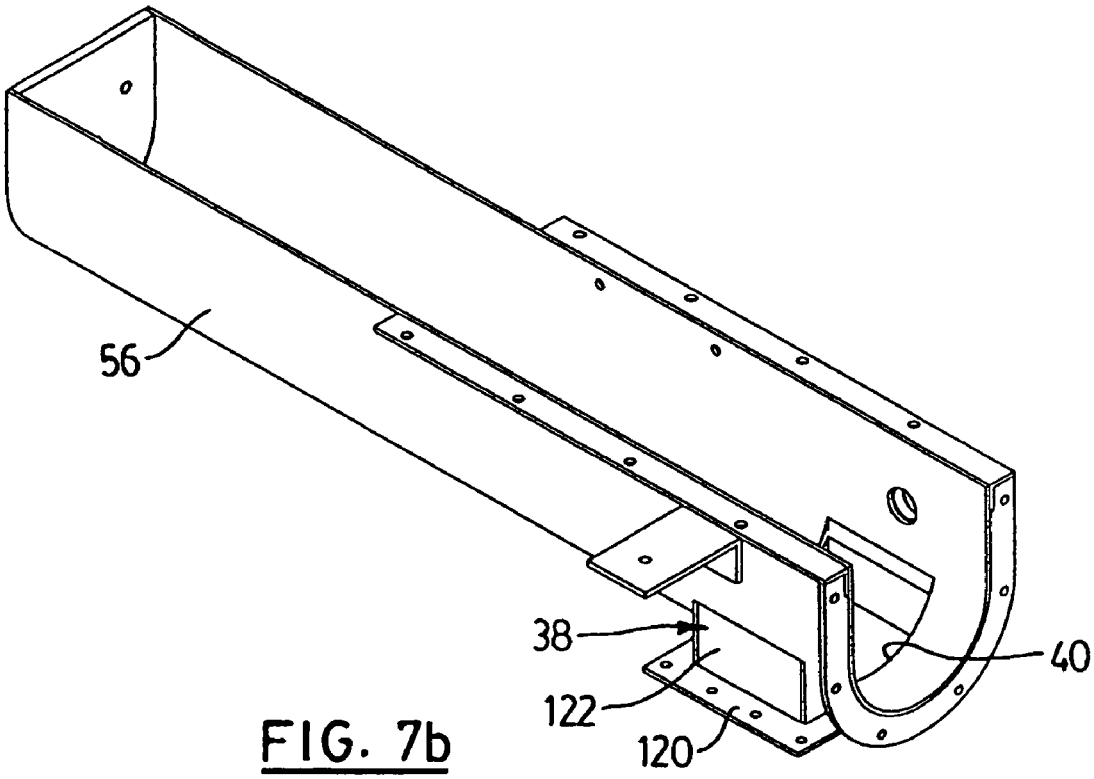
FIG. 7*b* is a rear isometric view of FIG. 7*a;*

Referring to FIGS. 7*a* and 7*b*, the discharge chute 38 is better illustrated. As can be seen, discharge chute 38 includes a chute flange 120 that extends from a lower edge of a chute body 122. The chute body 122 is welded to the feeder outlet 40 of the trough 56 to direct particulate refractory material from the feeder 34 into the accumulator box 42.

Figure 8:
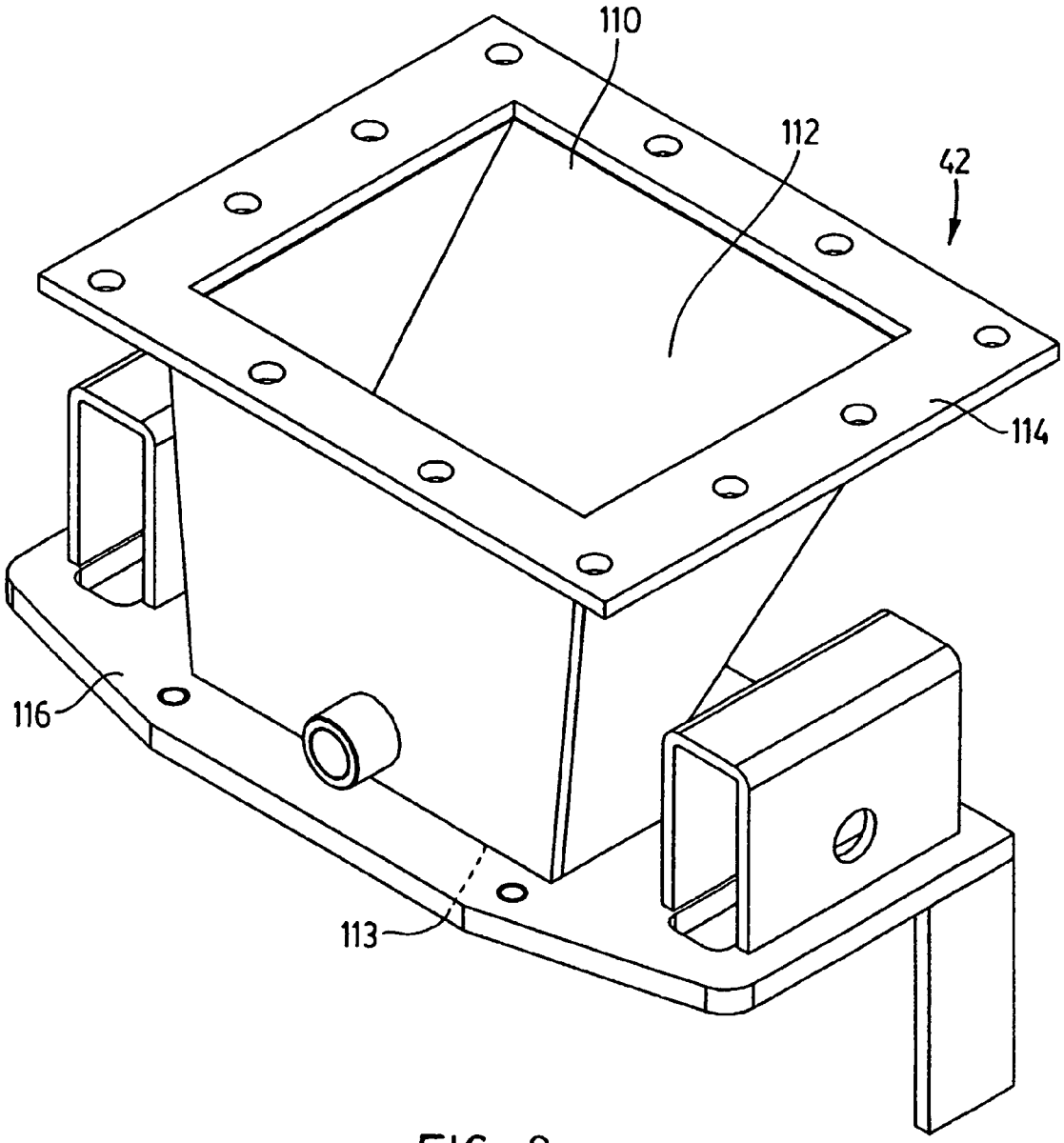
FIG. 8 is a front isometric view of portions of FIG. 1.

Turning now to FIG. 8, the accumulator box 42 is shown. The accumulator box 42 receives particulate refractory material via the discharge chute 38 at a rate that is determined by the rotational speed of the auger 50. The accumulator box 42 includes an inlet 110 that is surrounded by an upper flange 114, and a sloping wall 112 for directing particulate refractory material towards an outlet 113. The outlet 113 has a smaller cross-sectional area than the inlet 110 so that particulate refractory material typically experiences a delay from the time it enters the inlet 110 to the time it exits the outlet 113. Fasteners (not shown) are provided to secure the upper flange 114 of the accumulator box 42 to the chute flange 120 of the discharge chute 38. A lower flange 116 surrounds the outlet 113 of the accumulator box 42 and is provided for mating with a connecting flange 118 of the retractable shaft assembly 44.

Figure 9:
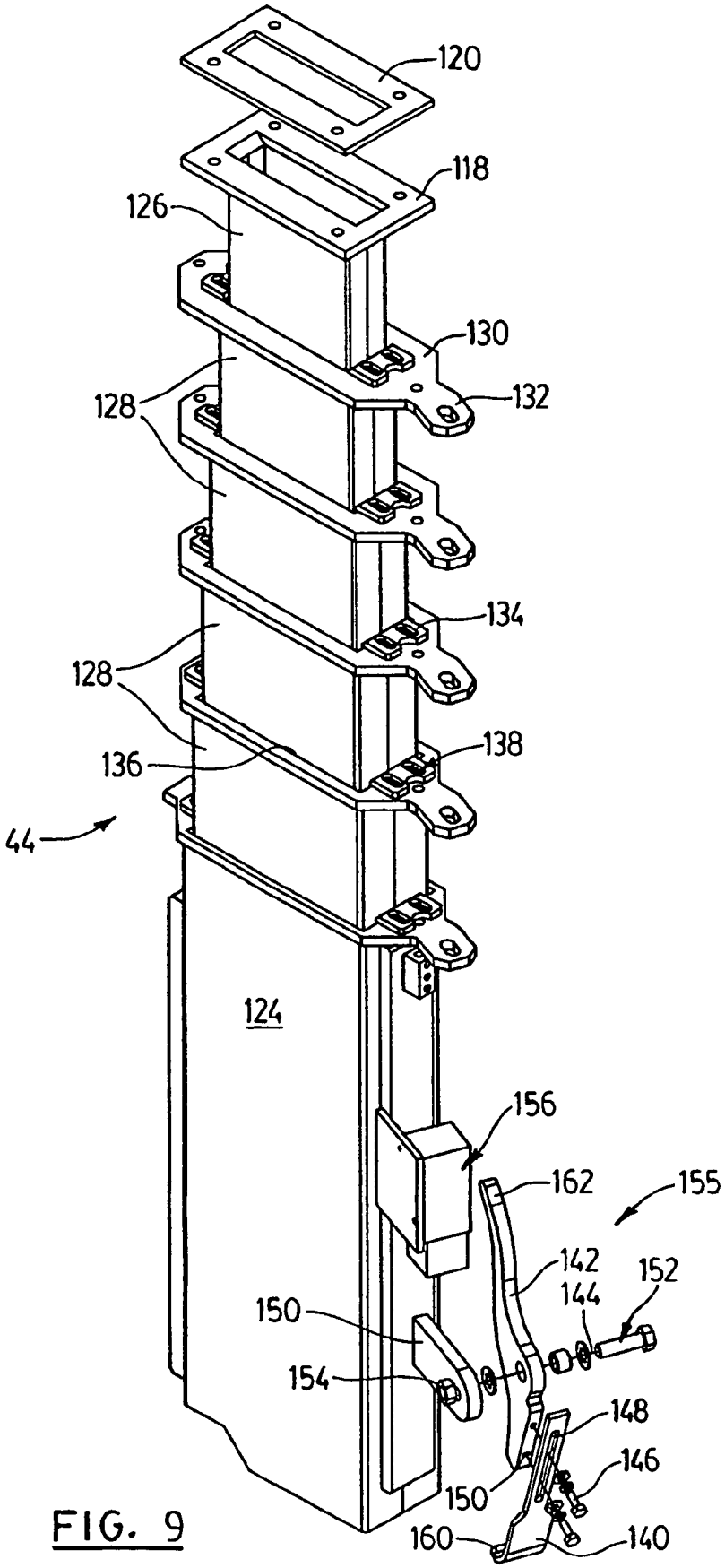
FIG. 9 is a front isometric view of portions of FIG. 1.

The retractable shaft assembly 44 is shown in FIG. 9. A connecting plate 120 is provided between the lower flange 116 of the accumulator box 42 and the connecting flange 118 of the retractable shaft assembly 44. The retractable shaft assembly 44 includes a main shaft 124, a first retractable shaft 126 and a series of intermediate shafts 128. Four intermediate shafts 128 are shown, however, any number of shafts 128 may be used to achieve the desired length. The intermediate shafts 128 and the first retractable shaft 126 telescope from the main shaft 124 between a retracted position and an extended position. The main shaft 124 and the intermediate shafts 128 each include an upper flange 130 having a lug 132 projecting from a side edge thereof. A pair of tube retainers 134 is provided adjacent opposing sides of the upper openings 136 in each of the shafts 124 and 128 respectively. Cables (not shown) extend through holes 138 provided in the upper flange 130 and the tube retainers 134 to enable the overall length of the retractable shaft assembly 44 to be adjusted.

A level sensor generally indicated at 155 is provided to detect the height of the particulate refractory material deposited in the lining gap. The level sensor 155 is coupled to the retractable shaft assembly 44 at a lower end of the main shaft 124. The level sensor 155 comprises a limit trip blade 140 that is coupled to a limit switch trip arm 142. Fasteners 146 extend through a slot 148 provided in the limit trip blade 140 and mate with holes 150 provided in the limit switch trip arm 142. The limit trip blade 140 includes a surface-contacting flange 160 that contacts the particulate refractory material deposited in the lining gap as the retractable shaft assembly 44 moves along the lining gap path. The limit switch trip arm 142 is coupled to a projecting lug 150 by a bolt assembly 152 and a nut 154 and is pivotable about a pivot axis 144. An upper end 162 of the limit switch trip arm 142 selectively communicates with a cable controller box 156 to adjust the cable length and thereby control the length of the retractable shaft assembly 44. The retractable shaft assembly 44 retracts when the forward progress of the limit trip blade 140 is resisted by particulate refractory material of increased depth within the lining gap. Resistance to the forward movement of the limit trip blade 140 causes the limit switch trip arm 142 to move into contact with the cable controller box 156. This causes the cable controller box 156 to shorten the cable length by approximately ½ inch. As a result, the limit switch trip arm 142 moves out of contact with the cable controller box 156 and the surface-contacting flange 160 again contacts the surface of the particulate refractory material deposited in the lining gap.

Figure 10:
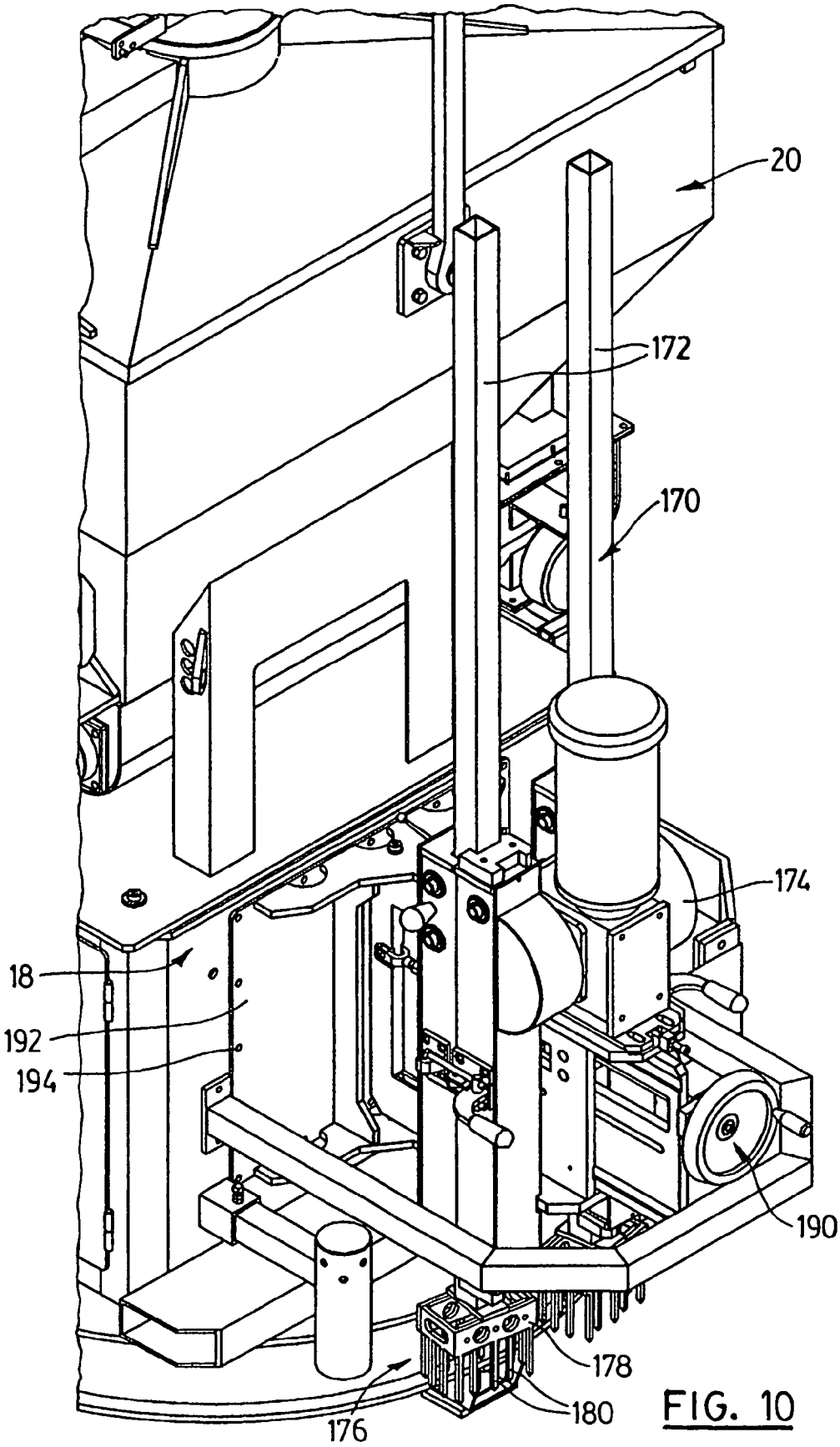
FIG. 10 is a rear isometric view of portions of FIG. 2.
Figure 11:
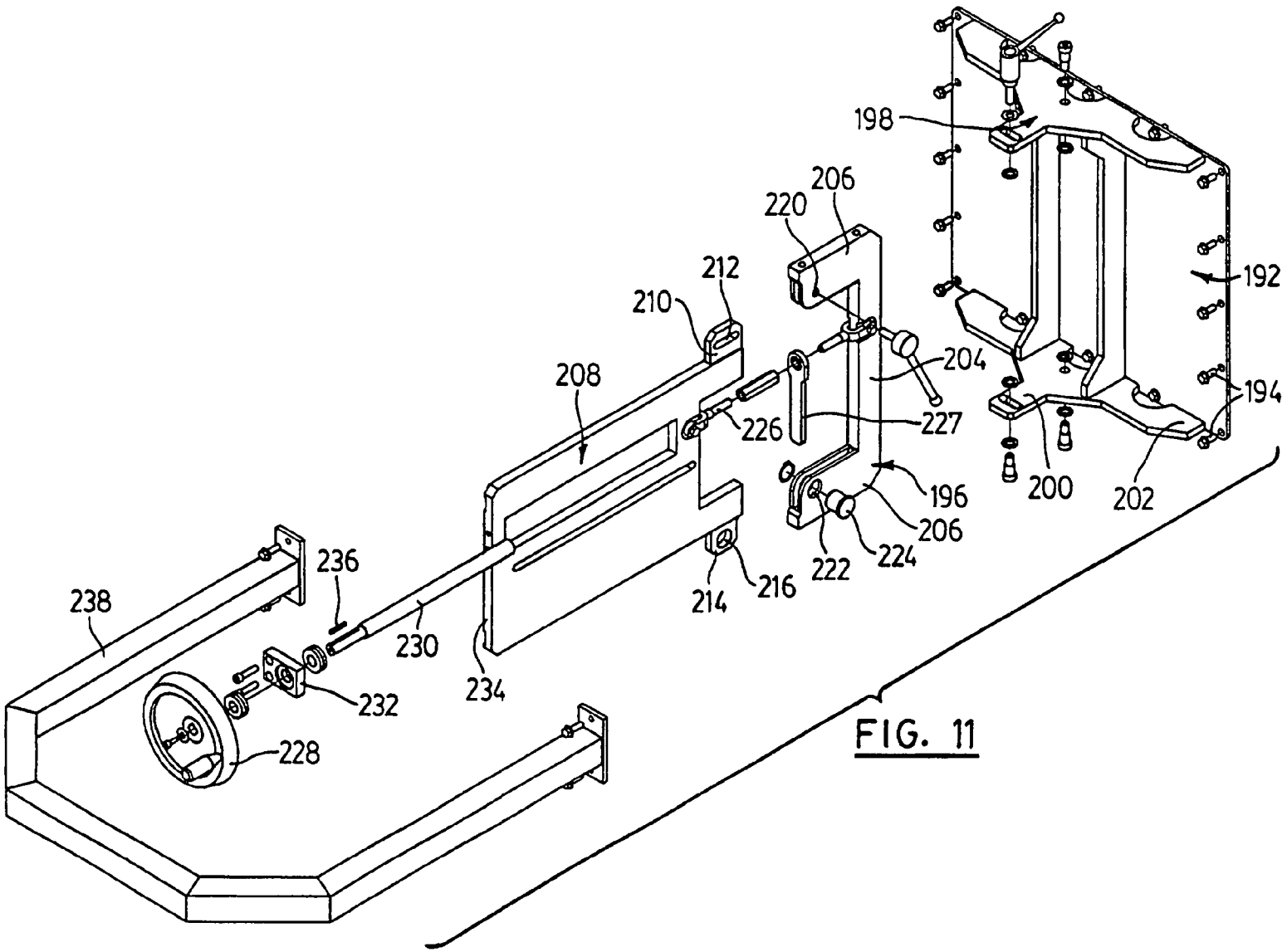
FIG. 11 is an exploded isometric view of portions of FIG. 10.

Referring now to FIG. 10, an air extractor device 170 and an air extractor mount assembly 190 are generally shown. The air extractor mount assembly 190 comprises an air extractor mounting plate 192. The air extractor mounting plate 192 is secured to a side panel of the housing 18 by fasteners 194. As shown in FIG. 11, a bracket assembly 202 projects from the mounting plate 192. A tilt unit frame 196 is coupled to upper and lower bracket members 198, 200 of the bracket assembly 202. The tilt unit frame 196 is generally C-shaped and includes a central body 204 and a pair of free arms 206. Each free arm 206 generally has U-shaped cross-section. A tilt unit 208 includes an upper lug 210 having a slot 212 formed therein and a lower lug 214 having an aperture 216 formed therein. The upper and lower lugs 210, 214 are sandwiched within the U-shape of the free arms 206 and are secured thereto. The slot 212 of the upper lug 210 is aligned with an aperture 220 formed in the upper free arm and receives an adjustable handle 218. The aperture 216 of the lower lug 214 is aligned with an aperture 222 of the lower free arm and receives a pivot pin 224.

A turnbuckle assembly 226 is provided between the tilt unit frame 196 and the tilt unit 208 for adjusting the distance therebetween and allowing the tilt unit 208 to pivot about the pivot pin 224. The turnbuckle assembly 226 is linked to a hand wheel 228 through an adjusting screw 230 by a key 236. The adjusting screw 230 is coupled to the hand wheel 228 through a bearing block 232, which is secured to a distal edge 234 of the tilt unit 208. A box ratchet 227 is provided to enable the turnbuckle assembly 226 to be manually adjusted.

An air extractor guard 238 surrounds the air extractor mount assembly 190 to protect the assembly 190 against accidental impact, which could cause the hand wheel 228 to move. Further, the air extractor guard 238 is provided to protect the operator from the moving parts of the air extractor device 170.

The air extractor device 170 is coupled to the tilt unit 208 of the air extractor mount assembly 190 and comprises a pair of reciprocating forks 172 coupled to a fork housing assembly 174. Each reciprocating fork 172 includes a prong assembly 176 that is secured to a lower end thereof. The prong assembly 176 includes a frame 178 having a plurality of downwardly extending prongs 180 coupled thereto. The reciprocating forks 172 are driven by an air extractor drive (not shown). The air extractor drive includes a cam that is coupled to the fork housing 174 to adjust the overall fork 172 height as the level of the particulate refractory material in the lining gap increases. The cam regularly lifts the reciprocating forks 172 above the surface of the particulate refractory material and then drops them down to the surface of the particulate refractory material. When dropped, the prongs 180 of the reciprocating forks 172 extend fully into the particulate refractory material within the lining gap and the frame 178 generally rests on top of the particulate refractory material. The up and down movement of the prongs 180 causes the particulate refractory material deposited within the lining gap to be re-compacted. The air extractor mount assembly 190 aids in the removal of air from the particulate refractory material by allowing the angle at which the air extractor device 170 contacts the particulate refractory material to be adjusted.

Figure 12:
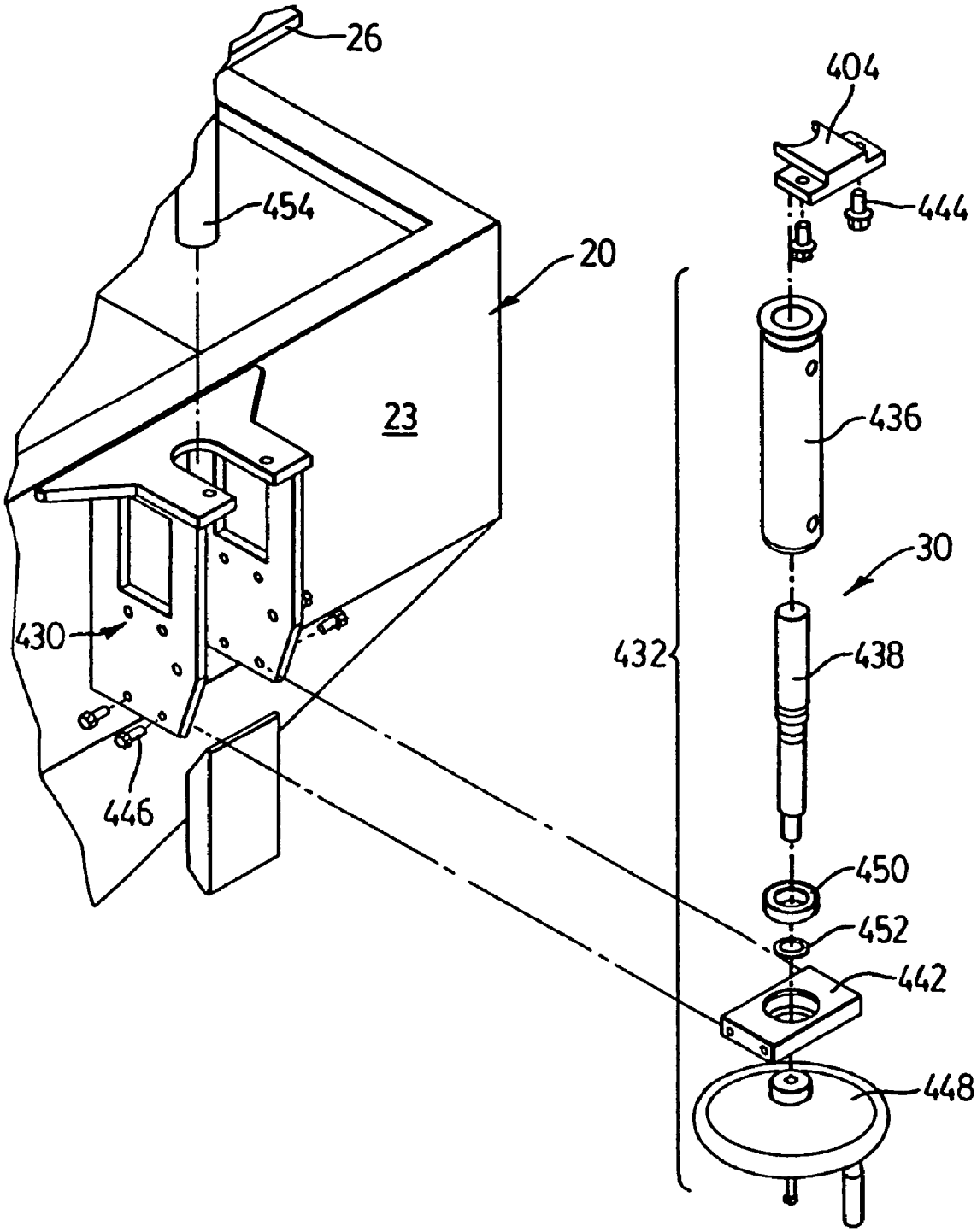
FIG. 12 is an exploded view of a lid lifter mechanism for a hopper.

Referring to FIG. 12, the lid lifter mechanism 30 is shown. The lid lifter mechanism 30 includes a support 430 that extends from the rear wall 23 of the hopper 20. A threaded lifting assembly 432 is coupled to the support 430 by mounting plates 440 and 442 that are secured by fasteners 444 and 446, respectively. The threaded lifting assembly 432 includes a tube 436 that receives a threaded member 438. First and second washer elements 450 and 452 are provided between the threaded member 438 and the mounting plate 442. The threaded member 438 is coupled to a hand wheel 448 so that rotation of the hand wheel 448 causes the threaded member 438 to move axially. A post 454 extends from the lid 26. The post 454 is mounted in the tube 436 and abuts the threaded member 438. Thus, rotation of the hand wheel 448 causes the lid to be raised or lowered. As shown in FIG. 2, a lid rotating arm 31 is provided for rotating the lid 26 out of the way of the inlet of the hopper 20. The lid rotating arm 31 is actuable once the lid 26 has been raised by the lid lifter mechanism 30. The lid rotating arm 31 pivots the lid 26 approximately 180 degrees away from the inlet of the hopper 20 to allow the hopper 20 to be filled with particulate refractory material.

During foundry furnace lining, the furnace bottom is compacted using a vibrating plate, and thereafter, the expendable form is centrally installed in the foundry furnace. The particulate dispensing apparatus 10 is then placed on the top of the expendable form in order to position the retractable shaft assembly 44 above the lining gap. Once the particulate dispensing apparatus 10 is in position, the lid 26 is raised and pivoted to uncover the inlet and the hopper 20 is filled with particulate refractory material. The particulate refractory material poured in the hopper 20 falls through the hopper 20, past the hopper outlet 36 and into the trough 56 of the feeder 34.

The driving means of the carriage 14 is then initiated to rotate the particulate dispensing apparatus 10 about the pivot axis of the platform 12 at a predetermined velocity. The feeder 34 is started by switching on the motor 54 and the air extractor is started by switching on the air extractor drive.

The auger 50, of the feeder 34, rotates about its axis to move the particulate refractory material through the trough 56 from the outlet 36 of the hopper 20 to the outlet 40 of the feeder 34. The spacing of the auger blade 70 controls the rate at which the particulate refractory material is moved towards the feeder outlet 40. The particulate refractory material then falls from the feeder outlet 34, through the discharge chute 38, and into the accumulator box 42. The reduced cross-sectional area of the outlet of the accumulator box 42 stalls the particulate refractory material so that it enters the retractable shaft assembly 44 at a predetermined flow rate.

The retractable shaft assembly 44 rotates with the carriage 14 to dispense particulate refractory material into the lining gap. The particulate dispensing apparatus 10 preferably delivers approximately 2 inches of particulate refractory material per revolution. As the depth of the particulate refractory material in the lining gap increases, the retractable shaft assembly 44 retracts to maintain the surface-contacting flange 160 in light contact with the surface of the particulate refractory material.

The air extractor device 170 also rotates with the carriage 14. The reciprocating forks 172 of the air extractor device 170 re-compact the particulate refractory material deposited in the lining gap to remove air therefrom. The air extractor device 170 moves upward as the depth of the particulate refractory material increases so that the prongs 180 of the reciprocating forks 172 continually contact the top portion of the particulate refractory material. The operator can use the hand wheel 228 to adjust the angle at which the reciprocating forks 172 contact the particulate refractory material to optimize the air extraction process. Removal of the air from the particulate refractory material ensures that a high quality lining is produced.

Particulate refractory material continues to be dispensed into the lining gap and re-compacted by the air extractor device 170 until the desired lining height has been reached. Once the desired lining height is reached, the particulate dispensing apparatus is removed from the expendable form. The lining is vibrated and then sintered, with the expendable form in place, to produce a continuous furnace lining.

Dispensing the particulate refractory material using the retractable shaft assembly 44 has an advantage in that the amount of airborne dust that arises as the particulate refractory material is dispensed is reduced because the particulate refractory material falls only a short distance before coming to rest. It is particularly important to reduce the amount of airborne particles when the particulate refractory material being dispensed is silica. The retractable shaft assembly 44 reduces the volume of airborne silica particles that may be inhaled by workers during the preparation of a foundry furnace lining.

The particulate dispensing apparatus 10 has applications in steel, ferrous and non-ferrous foundries. Applications include: lining of vertical channel furnaces, mechanical iron pouring ladles and transfer ladles.

Although a preferred embodiment of the present invention has been described, those of skill in the art will appreciate that variations and modifications may be made without departing from the spirit and scope thereof as defined by the appended claims.

What is claimed is:

1. A particulate dispensing apparatus for dispensing particulate refractory material gap between a furnace wall and a form comprising:

a frame assembly disposed above said form and including a carriage moveable along a circular path above said gap;

a particulate refractory material feed assembly on said frame assembly for delivering particulate refractory material in a smooth and consistent manner to a dispenser on said carriage, said dispenser delivering particulate refractory material into said gap and being suspended above and extendable into said gap to reduce the distance the particulate refractory material falls thereby to reduce the occurrence of airborne particulate material; and a drive for moving said carriage.

2. A particulate dispensing apparatus as claimed in claim 1 wherein said feed assembly comprises a hopper and a feeder, said hopper and feeder being configured to provide said smooth and consistent flow of particulate refractory material to said dispenser.

3. A particulate dispensing apparatus as claimed in claim 2 wherein said hopper has an outlet and includes generally steep inclined walls to provide smooth flow of particulate refractory material to the outlet.

4. A particulate dispensing apparatus as claimed in claim 3, wherein said feeder comprises a trough coupled to the outlet of said hopper for receiving said particulate refractory material and an auger coupled to said carriage and extending through said trough, said auger rotating about an auger axis to move particulate refractory material from the outlet of said hopper to said dispenser.

5. A particulate dispensing apparatus as claimed in claim 4, wherein said auger includes a continuous blade, the pitch of said blade increasing in a direction towards said dispenser.

6. A particulate dispensing apparatus as claimed in claim 5 further comprising an accumulator disposed between said feeder outlet and said dispenser, said accumulator delaying the progress of particulate refractory material from said feeder to said dispenser.

7. A particulate dispensing apparatus as claimed in claim 1 further comprising an air extractor device coupled to said carriage for removing air from particulate refractory material deposited in said gap and for recompacting the deposited particulate refractory material.

8. A particulate dispensing apparatus as claimed in claim 7, wherein said air extractor device comprises a pair of reciprocating forks.

9. A particulate dispensing apparatus as claimed in claim 8, wherein said dispenser comprises a telescoping shaft for receiving particulate refractory material from said feeder and delivering the particulate refractory material to said gap.

10. A particulate dispensing apparatus as claimed in claim 9, further comprising a sensor coupled to said dispenser for detecting the level of the particulate refractory material located in said gap and a controller for adjusting the length of said telescoping shaft to maintain said dispenser above the particulate refractory material located in said gap.

11. A particulate dispensing apparatus as claimed in claim 10 further comprising a viewing window adjacent to said feeder.

12. A particulate dispensing apparatus for dispensing particulate refractory material into a lining gap defined between an inner furnace surface and an expendable metal form, said particulate dispensing apparatus comprising:

a platform supporting a carriage adjacent an upper end of said expendable metal form, said carriage being pivotally coupled to said platform and rotatable about a pivot point located generally at the center of said platform;

a hopper coupled to said carriage, said hopper for receiving particulate refractory material via an inlet and dispensing said particulate refractory material through an outlet;

a feeder coupled to the outlet of said hopper, said feeder for moving the particulate refractory material from said outlet to a dispenser, said dispenser being coupled to said carriage at a distal end of said feeder and being suspended above and extendable into said lining gap to reduce the distance the particulate refractory material falls thereby to reduce the occurrence of airborne particulate material;

an air extractor device coupled to said carriage for removing air from particulate refractory material deposited in said lining gap and for re-compacting the particulate refractory material; and a drive for rotating said carriage relative to said platform.

13. A particulate dispensing apparatus as claimed in claim 12, wherein said feeder comprises a trough coupled to the outlet of said hopper for receiving said particulate refractory material and an auger coupled to said carriage and extending through said trough, said auger rotating about an auger axis to move particulate refractory material from the outlet of said hopper to said dispenser.

14. A particulate dispensing apparatus as claimed in claim 13, wherein said auger includes a continuous blade, the pitch of said blade increasing in a direction towards said dispenser.

15. A particulate dispensing apparatus as claimed in claim 12, wherein said air extractor device comprises a pair of reciprocating forks.

16. A particulate dispensing apparatus as claimed in claim 12, wherein said dispenser comprises a telescoping shaft for receiving particulate refractory material from said feeder and delivering the particulate refractory material to said lining gap.

17. A particulate dispensing apparatus as claimed in claim 16, further comprising a sensor coupled to said dispenser for detecting the level of the particulate refractory material located in said lining gap and a controller for adjusting the length of said telescoping shaft to maintain said dispenser above the particulate refractory material located in said lining gap.

18. A particulate dispensing apparatus as claimed in claim 17, wherein said feeder comprises a trough coupled to the outlet of said hopper for receiving said particulate refractory material and an auger coupled to said carriage and extending through said trough, said auger rotating about an auger axis to move particulate refractory material from the outlet of said hopper to said dispenser.

19. A particulate dispensing apparatus as claimed in claim 18, wherein said auger includes a continuous blade, the pitch of said blade increasing in a direction towards said dispenser.

20. A particulate dispensing apparatus as claimed in claim 19, wherein said air extractor device comprises a pair of reciprocating forks.

21. A particulate dispensing apparatus as claimed in claim 12, further comprising an accumulator coupled between said feeder outlet and said dispenser, said accumulator for delaying the progress of particulate refractory material from said feeder to said dispenser.

22. A particulate dispensing apparatus as claimed in claim 12, wherein said hopper and feeder are configured to provide smooth and consistent flow of particulate refractory material to said dispenser.

23. A particulate dispensing apparatus as claimed in claim 22 wherein said hopper includes generally steep inclined walls to provide smooth flow of particulate refractory material to the outlet thereof.

24. A particulate dispensing apparatus as claimed in claim 23, wherein said feeder comprises a trough coupled to the outlet of said hopper for receiving said particulate refractory material and an auger coupled to said carriage and extending through said trough, said auger rotating about an auger axis to move particulate refractory material from the outlet of said hopper to said dispenser.

25. A particulate dispensing apparatus as claimed in claim 24, wherein said auger includes a continuous blade, the pitch of said blade increasing in a direction towards said dispenser.

26. A particulate dispensing apparatus as claimed in claim 25 further comprising an accumulator disposed between said feeder outlet and said dispenser, said accumulator delaying the progress of particulate refractory material from said feeder to said dispenser.

27. A particulate dispensing apparatus as claimed in claim 12 further comprising a viewing window adjacent said feeder.

28. A particulate dispensing apparatus for dispensing particulate refractory material into a lining gap between an inner furnace wall and an expendable metal form, said particulate dispensing apparatus comprising:

a platform supporting a carriage adjacent an upper end of said expendable metal form, said carriage being pivotally coupled to said platform and rotatable about a pivot point located generally at the centre of said platform;

driving means for rotating said carriage relative to said platform;

a hopper coupled to said carriage, said hopper for receiving particulate refractory material via an inlet and dispensing said particulate refractory material through an outlet; and a feeder coupled to the outlet of said hopper, said feeder having an auger extending through the length thereof having an encircling blade for moving the particulate refractory material from said outlet to a dispenser, said dispenser being coupled to said carriage at a distal end of said feeder and being suspended above and extendable into said lining gap to reduce the distance the particulate refractory material falls thereby to reduce the occurrence of airborne particulate material;

wherein said auger blade has a variable pitch that increases in a direction toward said dispenser.

29. A particulate dispensing apparatus as claimed in claim 28, wherein said dispenser comprises a telescoping shaft for receiving particulate refractory material from said feeder and delivering the particulate refractory material to said lining gap.

30. A particulate dispensing apparatus as claimed in claim 29, further comprising a sensor coupled to said dispenser for detecting the level of the particulate refractory material located in said lining gap and a controller for adjusting the length of said telescoping shaft to maintain said dispenser above the particulate refractory material located in said lining gap.

31. A particulate dispensing apparatus as claimed in claim 28, wherein said hopper and feeder are configured to provide smooth and consistent flow of particulate refractory material to said dispenser.

32. A particulate dispensing apparatus as claimed in claim 31 wherein said hopper includes generally steep inclined walls to provide smooth flow of particulate refractory material to the outlet thereof.

33. A particulate dispensing apparatus as claimed in claim 32 further comprising an accumulator disposed between said feeder outlet and said dispenser, said accumulator delaying the progress of particulate refractory material from said feeder to said dispenser.

* * * * *